US010518554B2

(12) United States Patent
Van Acquoij et al.

(10) Patent No.: US 10,518,554 B2
(45) Date of Patent: Dec. 31, 2019

(54) COLOR PRINTER

(71) Applicant: Océ Holding B.V., Venlo (NL)

(72) Inventors: Catharinus Van Acquoij, Venlo (NL); Koen J. Klein Koerkamp, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/987,015

(22) Filed: May 23, 2018

(65) Prior Publication Data

US 2018/0339521 A1 Nov. 29, 2018

(30) Foreign Application Priority Data

May 24, 2017 (EP) ..... 17172731

(51) Int. Cl.

| | |
|---|---|
| ***B41J 29/38*** | (2006.01) |
| ***B41J 2/21*** | (2006.01) |
| ***B41J 11/00*** | (2006.01) |
| ***B41J 3/60*** | (2006.01) |
| ***B41J 2/205*** | (2006.01) |
| ***G03G 15/00*** | (2006.01) |

(52) U.S. Cl.

CPC ..... *B41J 2/2132* (2013.01); *B41J 2/2054* (2013.01); *B41J 3/60* (2013.01); *B41J 11/002* (2013.01); *B41J 11/007* (2013.01); *G03G 15/5029* (2013.01); *G03G 2215/00772* (2013.01)

(58) Field of Classification Search

USPC ..... 347/14

See application file for complete search history.

(56) References Cited

U.S. PATENT DOCUMENTS

| | | | | |
|---|---|---|---|---|
| 6,585,340 | B1 | 7/2003 | Borrell | |
| 7,295,224 | B2 * | 11/2007 | Busch | B41J 2/3555 347/188 |
| 2009/0102908 | A1 | 4/2009 | Imoto | |
| 2009/0322816 | A1 * | 12/2009 | Ihara | B41J 2/04528 347/14 |
| 2011/0222891 | A1 | 9/2011 | Kagami | |
| 2012/0147080 | A1 * | 6/2012 | Kodaira | B41J 11/002 347/17 |

FOREIGN PATENT DOCUMENTS

| | | |
|---|---|---|
| EP | 2 845 733 A1 | 3/2015 |
| JP | 8-23450 A | 1/1996 |
| JP | 2001-105636 A | 4/2001 |

OTHER PUBLICATIONS

European Search Report, issued in Application No. 17 17 2731, dated Nov. 6, 2017.

* cited by examiner

*Primary Examiner* — Lam S Nguyen

(74) *Attorney, Agent, or Firm* — Birch, Stewart, Kolasch & Birch, LLP

(57) ABSTRACT

A color printer includes a media transport system arranged to feed print media along a media transport path; a print engine disposed at the media transport path; a controller arranged to calculate an amount of coverage for each pixel and for each process color of an image to be printed on the media, and to control the print engine on the basis of the calculated amount of coverage; a temperature sensor; and a color correction module arranged to determine a correction of the amount of coverage on the basis of a temperature detected by the temperature sensor. The temperature sensor is arranged at the media transport path upstream of the print engine for detecting the temperature of the media as they reach the print engine.

8 Claims, 1 Drawing Sheet

COLOR PRINTER

BACKGROUND OF THE INVENTION

1. Field of the Invention

The invention relates to a color printer comprising a media transport system arranged to feed print media along a media transport path; a print engine disposed at the media transport path; a controller arranged to calculate an amount of coverage for each process color of an image to be printed on the media, and to control the print engine on the basis of the calculated amount of coverage; a temperature sensor; and a color correction module arranged to determine a correction of the amount of coverage on the basis of a temperature detected by the temperature sensor.

2. Description of the Related Art

U.S. Pat. No. 6,585,340 B1 discloses a printer of this type wherein a temperature sensor is arranged to detect a temperature in the environment of the printer. It is assumed that the temperature in the environment of the printer determines the temperature of the print media at the time when the image is being formed. Depending on the print process being applied, the temperature of the media may influence the visual color impression of the printed image. In an ink jet printer, for example, the media temperature influences the spread of ink droplets on the media surface, and consequently, changes in temperature may result in changes of the perceived color (density, chroma and hue) of the ink dot. The color correction module has the purpose to correct such color changes.

It is an object of the invention to improve the quality of the printed color images.

SUMMARY OF THE INVENTION

In order to achieve this object, the temperature sensor in the printer according to the invention is arranged at the media transport path upstream of the print engine for detecting the temperature of the media as they reach the print engine.

The invention is based on the observation that, even when the environmental temperature is constant, the temperature of the media at the time when they reach the print engine and the image is going to be formed may fluctuate due to different histories of the media sheets or different histories of different portions of a media web. The invention permits to detect such fluctuations and to determine the necessary color correction individually for the particular piece of media where the image is about to be formed.

The invention is particularly useful for a cut-sheet duplex printer wherein the sheets are subjected to a heat treatment, e.g. for curing the ink, fusing a toner image, or drying a media sheet. In that case, the temperature of the sheets that are recirculated through a duplex loop for printing an image on the back side of the sheet may deviate substantially from the temperature of the fresh sheets that are supplied to the print engine for the first time for printing an image on the front side. In the printer according to the invention, the temperature sensor may be arranged such that it is capable of detecting these deviations, so that suitable corrections may be applied for each print pass.

More specific optional feature of the invention are indicated in the dependent claims.

A second temperature sensor may be provided upstream of the first temperature sensor, for an early detection of the temperature of the media at a larger distance from the print station. In this case, at least a rough estimate for the temperature is obtained at an earlier time so that there is more time to apply the required color corrections to the bit map to be printed. The first temperature sensor may then be used for checking the temperature estimate and for applying minor corrections or calibrations, if necessary.

BRIEF DESCRIPTION OF THE DRAWINGS

An embodiment example will now be described in conjunction with the drawings, wherein.

DETAILED DESCRIPTION OF EMBODIMENTS

Figure 1:
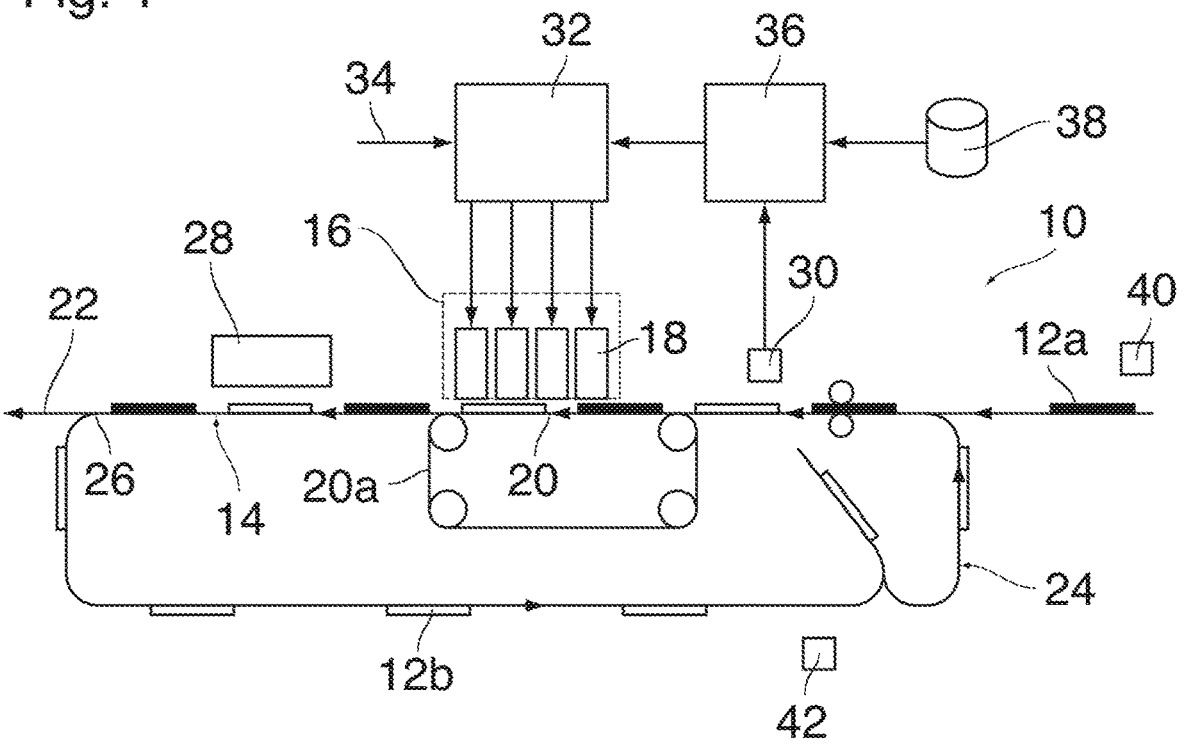
FIG. 1 is a schematic view of a color printer according to the invention.

The present invention will now be described with reference to the accompanying drawings, wherein the same or similar elements are identified with the same reference numeral.

The color printer shown in FIG. 1 comprises a media transport system 10 arranged to feed fresh media sheets 12*a* from a stack (not shown) along a media transport path 14. A print engine 16 is disposed at the media transport path 14 and includes a number of ink jet print heads 18 facing a portion of the media transport path that constitutes a print surface 20.

In the example shown, the print surface 20 is constituted by a portion of a perforated endless belt 20*a* which runs over a suction box (not shown) for attracting the sheets as they move past the print heads 18.

The media transport path 14 has a discharge branch 22 for discharging printed media sheets and a duplex loop 24 by which media sheets 12*b* on which an image has been printed on the first side are flipped and recirculated to the print engine 16 for receiving an image on their back side which is now facing upwards when the sheets move over the print surface 20 a second time. The sheets 12*b* which return from the duplex loop 24 are inserted into the stream of fresh sheets 12*a*, so that the sheets moving over the print surface 20 comprise fresh sheets 12*a* interleaved with sheets 12*b* bearing already a front side image. A switch 26 at the point where the media transport path 14 splits into the discharge branch 26 and the duplex loop 24 is controlled such that only the sheets 12*b* on which an image has been formed on the back side are directed into the discharge branch.

A curing station 28 is provided at the media transport path 14 between the print engine 16 and the switch 26 so as to cure the ink of each freshly printed image, regardless of whether it is a front side image or a back side image. The curing station 28 may for example comprise UV lamps for exposing UV-curing ink which forms the image. The curing treatment has the side effect that the temperature of the media sheet is increased. Consequently, when the sheets 12*b* are inserted into the stream of fresh media sheets 12*a*, they will have a higher temperature than the fresh sheets 12*a* because the sheets 12*b* have already been subjected to a curing treatment after the first print pass. A similar effect arises in a print process using water-based ink (not shown), wherein a drying step is applied to remove residual water from the media sheet. For this drying step a drying station may be applied, using e.g. infrared heaters or hot air impingement.

A temperature sensor 30 is disposed at the media transport path 14 upstream of the print engine 16 but downstream of the point where the duplex loop 24 merges into the main branch of the transport path. The temperature sensor is facing the top side of the media sheets 12*a* and 12*b* and is thus capable to detecting the temperature of that surface of the media sheets as the sheets move past the sensor at a time shortly before an image is formed on the same surface by the print engine 16. Alternatively, a temperature sensor may be facing the bottom side of the media sheets, since the temperature difference between the bottom side and top side is rather small. On the other hand, a measurement of the temperature on the side of the media sheet where the process colors are applied, is the most direct and accurate one.

As is well known in the art, the print engine 16 is controlled by an electronic controller 32 which receives, via a job input 34, job data specifying the features of the images to be printed, including their colors. The controller 32 includes a raster image processor (RIP) which converts the image data for each image to be printed into a bit map that specifies, for each process color (ink color) and each pixel, an amount of ink coverage that is necessary for obtaining the desired visual color impression. The amount of coverage that has to be determined for each color and each pixel depends upon several factors including the physical and chemical properties of the ink and its curing behavior, the material of the media sheets and also the surface temperature of the media sheets. It is common practice to establish and store a color profile which is specific to the media type of the sheets 12*a*, 12*b* and specifies for each target color (which may be a mixed color obtained by the combined effect of adjacent or partly superposed ink dots formed with different inks) the required amounts of coverage for each ink. These color profiles are usually established on the basis of the assumption that the temperature of the media sheets is a constant standard temperature.

In the printer shown in FIG. 1, a color correction module 36 is provided for determining a correction profile on the basis of the actual sheet temperature that has been detected by the temperature sensor 30. When the temperature sensor has detected the temperature of a sheet 12*a* or 12*b*, the correction profile determined by the color correction module 36 is sent to the RIP in the controller 32 for modifying the color profile.

In the example shown, color profiles for different media types and also for different temperatures of media sheets of the same type are stored in a data base, and the function of the correction module 36 is to select the profile that has been established for a temperature that is closest to the temperature measured by the temperature sensor 30.

In practice, it is convenient to establish a basic color profile that is specific only to the print process employed in the printer and to the inks of the process colors being used, but not to the media type and the temperature, and to take the media type and the temperature into account by providing for each media type and a set of different temperatures a set of correction curves that map an input coverage $D_i$ as determined by the basic color profile onto an output coverage $D_o$ which will eventually be used for controlling the print engine.

Figure 2:
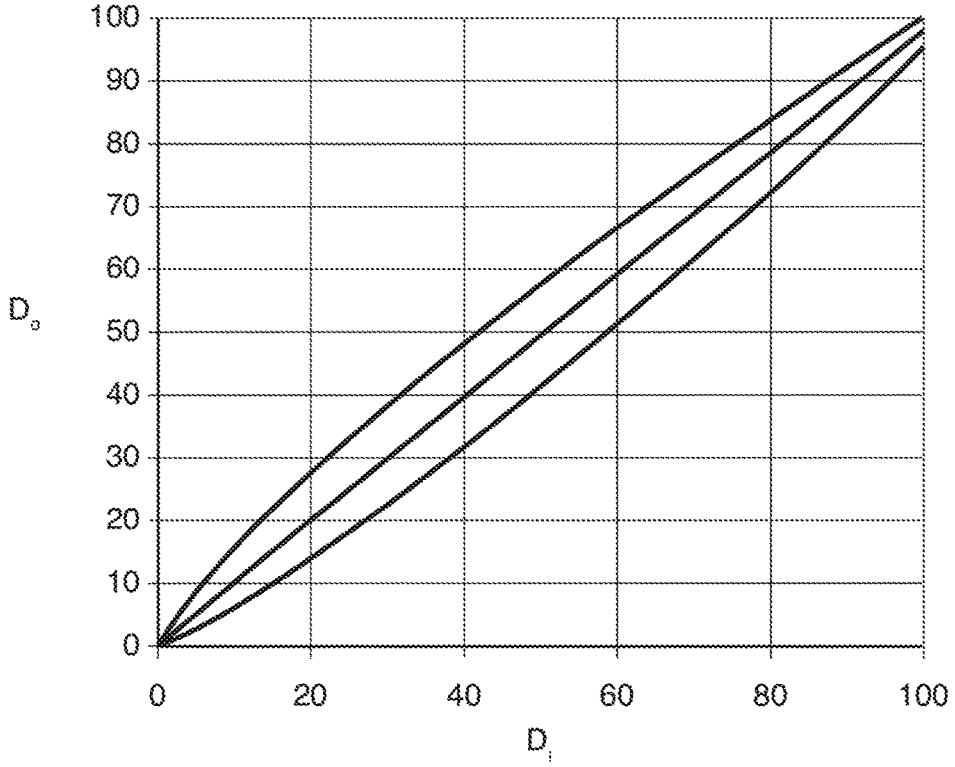
FIG. 2 shows examples of color correction curves for a given media type and a given color, but for different temperatures.

FIG. 2 shows examples of three such correction curves for different temperatures.

It will be understood that the correction curve to be used, and hence the temperature of the sheet, must be known before the raster image processing in the controller 32 can start. Since the RIP is a relatively time-consuming procedure, especially for large size high resolution images, it would be desirable to increase the distance between the position of the temperature sensor 30 and the print engine 16 along the sheet transport path, in order to have more time for the raster image processing. On the other hand, in terms of accuracy, it would be preferable to arrange the temperature sensor as closely as possible to the entry side of the print engine in order to avoid a possible temperature change in the time when the sheet moves from the temperature sensor 30 to the print engine. A possible way to resolve this conflict is to provide at least a second temperature sensor which is positioned further upstream and can be used to give at least a rough estimate of the temperature that the sheet will have when it arrives at the print engine.

In the example shown in FIG. 1, two additional temperature sensors 40, 42 are arranged at the media transport path 14. The sensor 40 is arranged for detecting the temperature of the fresh sheets 12*a* in an entry branch of the sheet transport path, and the sensor 42 detects the temperature of the sheets 12*b* in the duplex loop 24. As soon as the sheet temperature has been measured by the temperature sensor 40 or 42, the correction module 36 selects the correction curve to be applied, and the RIP processing is started. Then, when the sheet reaches the position of the first temperature sensor 30, this sensor is used for detecting a temperature change that has occurred during the travel of the sheet from the position of the sensor 40 or 42 to the position of the sensor 30. This measured deviation is then used for correcting the estimate for the sheet temperature for the next sheets on the basis of the detection result of the sensors 40, 42.

It will be understood that the invention is not limited to duplex printers but may be applied whenever media sheets are supplied to the print engine 16 from different sources and may therefore have different temperatures. The invention may be useful even in a case where the media are constituted by an endless web withdrawn from a roll. For example, when the roll is disposed near a heat source, a heat transfer from the heat source to the outmost layer of the web on the roll may cause fluctuations in temperature.

The invention being thus described, it will be obvious that the same may be varied in other ways. Such variations are not to be regarded as a departure from the scope of the invention, and all such modifications are intended to be included within the scope of the following claims.

The invention claimed is:

1. A color printer comprising:

a media transport system arranged to feed print media along a media transport path;

a print engine disposed at the media transport path;

a controller arranged to calculate an amount of coverage for each pixel and for each process color of an image to be printed on the media, and to control the print engine on the basis of the calculated amount of coverage;

a temperature sensor;

a color correction module arranged to determine a correction of the amount of coverage on the basis of a temperature detected by the temperature sensor; and at least a second temperature sensor arranged upstream of the first temperature sensor, wherein the temperature sensor is arranged at the media transport path upstream of the print engine for detecting the temperature of the media as the media reaches the print engine, and wherein the color correction module is arranged to determine the correction of the amount of coverage on the basis of a temperature estimate that is obtained by correcting the temperature measured by the second temperature sensor in accordance with a previously detected deviation between the temperatures which the first and second temperature sensors have detected for the same sheet.

2. The printer according to claim 1, the printer being a cut-sheet printer having a duplex loop and a treatment module having the effect to change the temperature of media sheets moving past the print engine.

3. The printer according to claim 2, wherein the treatment module is a UV curing station.

4. The printer according to claim 2, wherein the treatment module is a drying station.

5. The printer according to claim 1, wherein one of the controller and the color correction module is arranged to determine a preliminary amount of coverage on the basis of a standard color profile, and the color correction module is arranged to select, on the basis of the detected temperature, a correction curve mapping the preliminary amount of coverage onto a final amount of coverage.

6. The printer according to claim 1, wherein the color correction module includes a database of color profiles for different media and different temperatures of the media.

7. The printer according to claim 6, wherein the color correction module selects the color profile that has been established for a temperature that is closest to the temperature measured by the temperature sensor.

8. The printer according to claim 1, wherein the color correction module provides a correction color profile to the controller on the basis of a temperature detected by the temperature sensor.

* * * * *